United States Patent [19]

Okamura et al.

[11] Patent Number: 4,828,974

[45] Date of Patent: May 9, 1989

[54] PHOTOGRAPHIC LIGHT-SENSITIVE MATERIAL CONTAINING GELATIN HARDENER

[75] Inventors: Hisashi Okamura; Hiroshi Kawamoto, both of Kanagawa, Japan

[73] Assignee: Fuji Photo Film Co., Ltd., Kanagawa, Japan

[21] Appl. No.: 48,292

[22] Filed: May 11, 1987

[30] Foreign Application Priority Data

May 9, 1986 [JP] Japan ..... 61-105976

[51] Int. Cl.[4] ..... G03C 1/30

[52] U.S. Cl. ..... 430/623; 430/546

[58] Field of Search ..... 430/623

[56] References Cited

U.S. PATENT DOCUMENTS

| | | | |
|---|---|---|---|
| 4,063,952 | 12/1977 | Himmelmann et al. | 430/623 |
| 4,338,394 | 7/1982 | Himmelmann et al. | 430/623 |
| 4,543,324 | 9/1985 | Himmelmann | 430/623 |
| 4,618,573 | 10/1986 | Okamura et al. | 430/623 |
| 4,673,632 | 6/1987 | Okamura et al. | 430/623 |

*Primary Examiner*—Paul R. Michl
*Assistant Examiner*—Mark R. Buscher
*Attorney, Agent, or Firm*—Sughrue, Mion, Zinn, Macpeak and Seas

[57] ABSTRACT

A photographic light-sensitive material containing a novel gelatin hardener is disclosed, which comprises as a gelatin hardener at least one compound represented by formula (I)

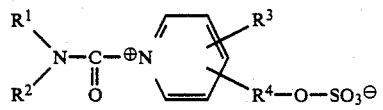

(I)

wherein $R^1$ and $R^2$ each represents a substituted or unsubstituted alkyl group, a substituted or unsubstituted aryl group, or a substituted or unsubstituted aralkyl group, or $R^1$ and $R^2$ together represent a nitrogen-containing heterocyclic ring; $R^3$ represents a hydrogen atom, a halogen atom, an alkyl group, an aryl group, an aralkyl group, or an alkoxy group; and $R^4$ represents a chemical bond, or an alkylene group, an arylene group, or a divalent group composed of these groups. The compound represented by formula (I) provides rapid hardening progress, prevents after-hardening, and does not undergo hardening inhibition when applied to silver halide color photographic materials.

10 Claims, No Drawings

PHOTOGRAPHIC LIGHT-SENSITIVE MATERIAL CONTAINING GELATIN HARDENER

FIELD OF THE INVENTION

This invention relates to a photographic light-sensitive material containing an improved gelatin hardener, and more particularly to a silver halide photographic material containing at least one gelatin hardener.

BACKGROUND OF THE INVENTION

Many photographic light-sensitive materials employ gelatin in layer as a binder, and gelatin can be hardened with various known compounds to ensure water resistance and mechanical strength of the gelatin layer.

Compounds known as gelatin hardeners include, for example, aldehyde compounds, e.g., formaldehyde, glutaraldehyde, etc.; compounds having a reactive halogen as described in U.S. Pat. No. 3,288,775; compounds having a reactive ethylenically unsaturated bond as described in U.S. Pat. No. 3,642,486 and Japanese Patent Publication No. 13563/74; aziridine compounds as described in U.S. Pat. No. 3,017,280; epoxy compounds as described in U.S. Pat. No. 3,091,537; halogencarboxylaldehydes, e.g., mucochloric acid, etc.; dioxanes, e.g., dihydroxydioxane, dichlorodioxane, etc.; and inorganic hardeners, e.g., chromium alum, zirconium sulfate, etc.

However, each of these known gelatin hardeners has one or more disadvantages, when used in photographic light-sensitive materials, such as (1) insufficient hardening effect, (2) long-term change in the degree of hardening, called after-hardening (arising from slow hardening reactivity), (3) adverse influences on photographic characteristics to cause, in particular, increase of fog and reduction of sensitivity, (4) loss of hardening effect due to other coexisting photographic additives, (5) adverse influences on other photographic additives, e.g., color couplers, to reduce their effects, and the like.

Hardeners exhibiting relatively high reaction rates on gelatin so as not to cause after-hardening have been proposed, including compounds having a dihydroquinoline skeleton as described in Japanese Patent Application (OPI) No. 38540/75 (the term "OPI" as used herein refers to a "published unexamined Japanese patent application"); compounds having a phosphorus-halogen bond as described in Japanese Patent Application (OPI) No. 113929/83; compounds having an N-sulfonyloxyimide group as described in Japanese Patent Application (OPI) No. 93470/77; compounds containing at least two N-acyloxyimino groups per molecule as described in Japanese Patent Publication No. 22089/78; N-carbamoylpyridinium salts as described in Japanese Patent Publication Nos. 12853/81 and 32699/83; 2-sulfonyloxypyridinium salts as described in Japanese Patent Application (OPI) No. 110762/81, etc.

These hardeners are characterized by their rapid hardening effects, causing less after-hardening. Inter alia, the hardeners described in Japanese Patent Publication No. 32699/83 exhibit excellent performances, such as a rapid hardening rate, good water-solubility which eliminates necessity of any special organic solvent on coating, freedom from a pyridine odor as compared with the compounds of Japanese Patent Publication No. 12853/81 (thus reducing the risk of harm to the health of workers), and the like.

Nevertheless, when the compounds of Japanese Patent Publication No. 32699/83 are used for hardening a gelatin layer of silver halide color photographic materials, they frequently suffer from inhibition of hardening, and fail to achieve sufficient hardening of the gelatin layer.

In general, silver halide color photographic materials comprise a support having provided thereon a plurality of gelatin layers, in some of which various photographically useful substances dissolved in high-boiling organic solvents are dispersed with the aid of surface active agents called emulsifiers, while exercising their respective intended functions. Among photographically useful substances are many compounds that are very apt to react with gelatin hardeners having high hardening reaction rates, typically exemplified by couplers. Therefore, when such a gelatin hardener that shows satisfactory performances in black-and-white photographic materials containing no high-boiling organic solvent is applied to color photographic materials, not only is sufficient hardening of photographic layers not assured, but also it often happens that the hardener reacts with, for example, a coupler, to seriously reduce maximum density of the resulting photographic image, or with an antifoggant to cause, on the contrary, a serious increase of a minimum density of the image, thus resulting in a considerable impairment of the commercial value of the materials. The causes of these phenomena have not yet been clearly elucidated, but it is believed that the gelatin hardener becomes incorporated into the aforesaid high-boiling organic solvent and undergoes chemical reaction with the photographically useful substance which is dispersed therein together with the organic solvent. Therefore, as the hardening rate of a gelatin hardener increases to show higher reactivity to a photographically useful substance, the above-described defect of hardening inhibition tends to become serious.

With the recent demand for reduction of development time of silver halide photographic materials, photographically useful substances to be employed therefor, e.g., couplers, tend to have so much increased reactivities. It is easily anticipated that the phenomenon of hardening inhibition would become more pronounced with this tendency. Therefore, a gelatin hardener which has a high hardening rate but is still free from hardening inhibition even when applied to silver halide color photographic materials has been keenly desired.

SUMMARY OF THE INVENTION

An object of this invention is to provide a photographic light-sensitive material containing a novel gelatin hardener.

Another object of this invention is to provide a photographic light-sensitive material containing a gelatin hardener which exhibits a rapid hardening effect on gelatin so as not to cause after-hardening.

A further object of this invention is to provide a photographic light-sensitive material containing a gelatin hardener which does not suffer from hardening inhibition when applied to silver halide color photographic materials.

As a result of extensive investigations, it has now been found that the above objects can be accomplished by a photographic light-sensitive material comprising a support and at least one gelatin-containing layer provided on the support, wherein said gelatin-containing layer contains as a gelatin hardener at least one compound represented by the formula (I)

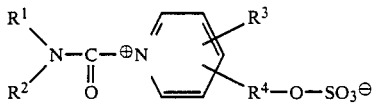

(I)

wherein $R^1$ and $R^2$ (which may be the same or different) each represents a substituted or unsubstituted alkyl group, a substituted or unsubstituted aryl group, or a substituted or unsubstituted aralkyl group, or $R^1$ and $R^2$ together represent a nitrogen-containing heterocyclic ring; $R^3$ represents a hydrogen atom, a halogen atom, an alkyl group, an aryl group, an aralkyl group, or an alkoxy group; and $R^4$ represents a chemical bond, or an alkylene group, an arylene group, or a divalent group composed of these groups (i.e., composed of alkylene and arylene groups).

DETAILED DESCRIPTION OF THE INVENTION

In formula (I), preferably $R^1$ and $R^2$ each represents a straight or branched chain alkyl group having from 1 to 20 carbon atoms (e.g., a methyl group, an ethyl group, a butyl group, a 2-ethylhexyl group, etc.), an aralkyl group having from 7 to 20 carbon atoms (e.g., a benzyl group, a phenethyl group, etc.), or an aryl group having from 6 to 20 carbon atoms (e.g., a phenyl group, etc.). More preferably, $R^1$ and $R^2$ each represents an alkyl group having from 1 to 3 carbon atoms (e.g., a methyl group, an ethyl group, a propyl group, an isopropyl group, etc.) or a phenyl group. The substituents for these groups preferably include a halogen atom (e.g., a chlorine atom, etc.), an alkoxy group having from 1 to 10 carbon atoms (e.g., a methoxy group), and an aryloxy group having from 6 to 10 carbon atoms (e.g., a phenoxy group, etc.). It is also preferred that $R^1$ and $R^2$ together represent a ring, and particularly a pyrrolidine ring, a piperidine ring, or a morpholine ring.

$R^3$ preferably represents a hydrogen atom, a halogen atom (e.g., a chlorine atom, etc.), an alkyl group having from 1 to 20 carbon atoms (e.g., a methyl group, an ethyl group, etc.), an aryl group having from 6 to 20 carbon atoms (e.g., a phenyl group, etc.), an aralkyl group having from 7 to 20 carbon atoms (e.g., a benzyl group, a phenethyl group, etc.) or an alkoxy group having from 1 to 20 carbon atoms (e.g., a methoxy group, etc.), with a hydrogen atom being more preferred.

$R^4$ preferably represents a chemical bond, or an alkylene group having from 1 to 20 carbon atoms (e.g., a methylene group, an ethylene group, a trimethylene group, a propylene group, etc.), an arylene group having from 6 to 20 carbon atoms (e.g., a phenylene group, etc.) or a divalent group composed of these groups having from 7 to 20 carbon atoms (e.g.,

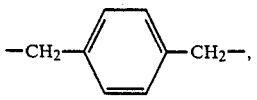

etc.). More preferably, $R^4$ represents a chemical bond, a methylene group, an ethylene group, or a trimethylene group.

Specific but non-limiting examples of compounds represented by formula (I) in accordance with the present invention are shown below.

Compound 1

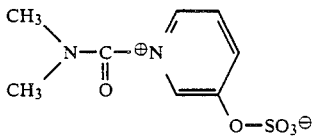

Compound 2

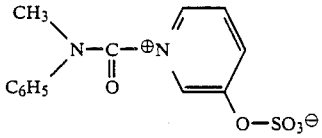

Compound 3

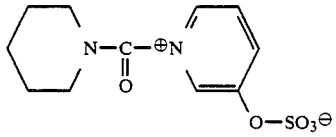

Compound 4

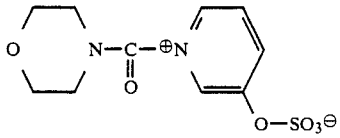

Compound 5

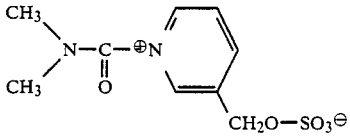

Compound 6

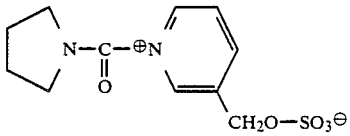

Compound 7

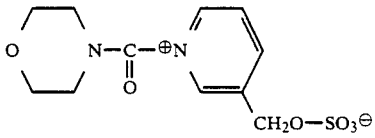

Compound 8

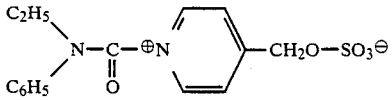

Compound 9

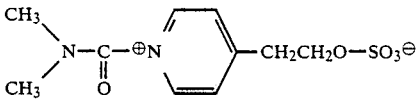

Compound 10

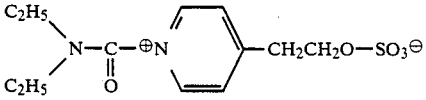

Compound 11

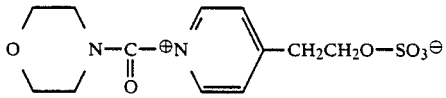

-continued

Compound 12

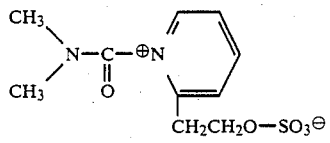

Compound 13

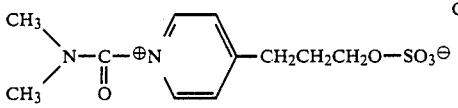

Compound 14

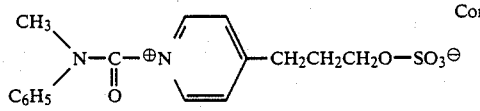

Compound 15

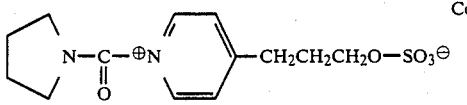

Compound 16

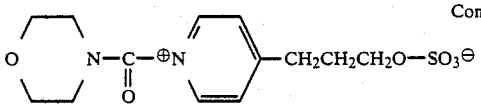

Compound 17

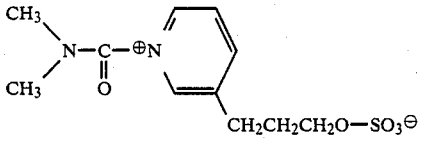

Compound 18

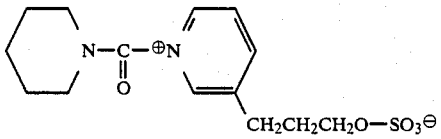

Compound 19

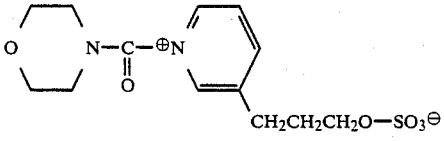

Compound 20

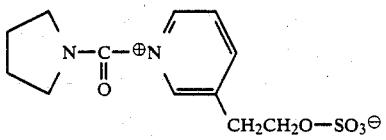

Compound 21

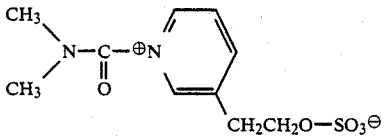

Compound 22

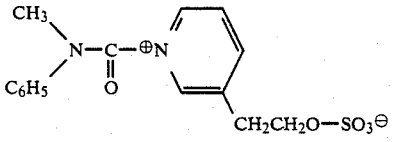

-continued

Compound 23

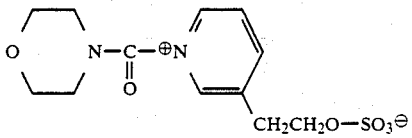

Compound 24

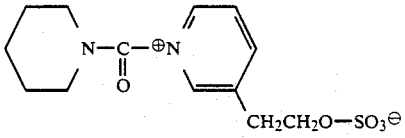

Synthesis examples of the compounds according to the present invention are shown below.

SYNTHESIS EXAMPLE 1

(1) Synthesis of Mono-3-(4-pyridyl)propyl Sulfate

To a solution of 10 g of 4-(3-hydroxypropyl)pyridine in 120 ml of chloroform was added 11.8 g of a sulfur trioxide-pyridine complex at room temperature, followed by stirring for 24 hours. The precipitated crystals were collected by filtration and dried to obtain 12.5 g of the desired compound..

The product was identified by standard spectra of NMR and IR analyses and elementary analysis.

(2) Synthesis of Compound 13

In 40 ml of dimethylformamide and 40 ml of methanol was dispersed 6.5 g of the above-prepared mono-3-(4-pyridyl)propyl sulfate, and 6.4 g of a 28 wt % methanolic solution of sodium methylate was added thereto. To the resulting clear solution was added dropwise 3.2 g of N,N-dimethylcarbamoyl chloride at room temperature, followed by stirring for 24 hours. The precipitated sodium chloride was removed by filtration, and 400 ml of tetrahydrofuran was added to the filtrate. The precipitated crystals were collected by filtration and dried to obtain 8 g of Compound 13.

The product was identified by NMR and IR spectra and elementary analysis. The resulting crystals were found to contain 16 wt % of sodium chloride.

SYNTHESIS EXAMPLE 2

(1) Synthesis of Mono-3-(3-pyridyl)propyl Sulfate

The procedure of Synthesis Example 2-1) was repeated, except for using 3-(3-hydroxypropyl)pyridine in place of 4-(3-hydroxypropyl)pyridine, to obtain 8 g of the desired compound.

The product was identified by NMR and IR spectra and elementary analysis.

(2) Synthesis of Compound 19

In 20 ml of dimethylformamide and 20 ml of methanol was dissolved 3.3 g of the above-prepared mono-3-(3-pyridyl)propyl sulfate, and 3.2 g of a 28 wt % of methanolic solution of sodium methylate was added thereto. To the resulting clear solution was added dropwise 2.2 g of morpholinocarbonyl chloride at room temperature, followed by stirring at room temperature for 24 hours. The precipitated sodium chloride was removed by filtration, and 200 ml of tetrahydrofuran was added to the filtrate. The precipitated crystals were collected by filtration to obtain 4 g of Compound 19.

The product was identified by NMR and IR spectra and elementary analysis. The resulting crystals were found to contain 16 wt % of sodium chloride.

Other compounds of the present invention could be prepared by analogy with the process described in the synthesis examples, particularly by appropriate selection of the starting materials.

When the compounds of this invention are used as a hardener in gelatin-containing photographic layers, there are observed substantially no unfavorable phenomena, such as deterioration in photographic characteristics, e.g., increased fog and reduced sensitivity, stain formation, undesired reactions with couplers, etc., present in color photographic materials, and the like. Furthermore, they show rapid progress of hardening, attaining the maximum degree of hardening within a few days from the coating and, thereafter, show no further increase of hardening, i.e., after-hardening.

The amount of the hardening agent to be used in the present invention can be selected appropriately depending on the intended use, and usually ranges from 0.01 to 20% by weight, and preferably from 0.05 to 10% by weight, based on the weight of dry gelatin.

The hardener according to the present invention is also effective for extending a gelatin chain length by partially hardening gelatin using a relatively small amount of the hardening agent, as disclosed in Japanese Patent Application (OPI) No. 2324/81, and may further be used for hardening the gelatin having the thus extended chain length.

The hardener according to the present invention can be applied to any and every kind of photographic light-sensitive materials using gelatin, including color negative films, color reversal films, color positive films, color papers, color reversal papers, and color light-sensitive materials of color diffusion transfer system or silver dye bleaching system, as well as black-and-white light-sensitive materials, such as black-and-white films, X-ray films, films for photomechanical processes, black-and-white papers, aerial films, microfilms, films for facsimiles, photographic films or papers, films for graphs, etc. It is particularly preferred that the photographic material containing the hardener of the present invention is a color photographic light-sensitive material.

The photographic layers in which the hardener can be incorporated are not particularly limited as long as they contain gelatin, including not only silver halide emulsion layers, but also light-insensitive layers, e.g., a subbing layer, a backing layer, a filter layer, an intermediate layer, an overcoat layer, etc.

The hardeners of the present invention may be used either aloe or in combinations of two or more thereof, or in combination with other known hardeners. Examples of such other known hardeners are aldehyde compounds, e.g., formaldehyde, glutaraldehyde, etc.; ketone compounds, e.g., diacetyl, cyclopentadione, etc.; compounds having a reactive halogen, e.g., bis(2-chloroethylurea), 2-hydroxy-4,6-dichloro-1,3,5-triazine and those disclosed in U.S. Pat. Nos. 3,288,775 and 2,732,303 and British Pat. Nos. 974,723 and 1,167,207; compounds having a reactive olefin, e.g., divinylsulfone, 5-acetyl-1,3-diacryloylhexahydro-1,3,5-triazine and those disclosed in U.S. Pat. Nos. 3,635,718 and 3,232,763 and British Patent 994,869; N-methylol compounds, e.g., N-hydroxymethylphthalimide and those disclosed in U.S. Pat. Nos. 2,732,316 and 2,586,168; isocyanate compounds as disclosed in U.S. Pat. No. 3,103,437; aziridine compounds as disclosed in U.S. Pat. Nos. 3,017,280 and 2,983,611; acid derivatives as disclosed in U.S. Pat. Nos. 2,725,294 and 2,725,295; carbodiimide compounds as disclosed in U.S. Pat. No. 3,100,704; epoxy compounds as disclosed in U.S. Pat. No. 3,091,537; isooxazole compounds as disclosed in U.S. Pat. Nos. 3,321,313 and 3,543,292; halogencarboxyaldehydes, e.g., mucochloric acid; dioxane derivatives, e.g., dihydroxydioxane, dichlorodioxane, etc.; the aforesaid dihydroquinoline compounds, compounds having a phosphorus-halogen bond, N-sulfonyloxyimide compounds, and N-acyloxyimino compounds; N-carbonyloxyimide compounds as disclosed in Japanese Patent Application (OPI) No. 43353/81; 2-sulfonyloxypyridinium salts; N-carbamoylpyridinium salts; and inorganic hardeners, e.g., chromium alum, zirconium sulfate, etc. These known hardeners may be used in the form of their precursors, such as alkali metal bisulfite/aldehyde adducts, methylol derivatives of hydantoin, primary aliphatic nitro alcohols, mesyloxyethylsulfonyl compounds, chloroethylsulfonyl compounds, and the like. The proportion of the hardener of the invention to other known hardeners, if used in combination, can be selected according to the particular purposes or effects desired, but is preferably at least 50 mol % based on the total amount of hardeners used.

Compounds which accelerate gelatin hardening can be used in combination. For example, a polymer containing a sulfinic acid group as disclosed in Japanese Patent Application (OPI) No. 4141/81 can be used as a hardening accelerator in combination with a hardening system composed of the hardener of the invention and a known vinylsulfone type hardener.

Gelatin to which the hardener of the present invention is applicable may be any of alkali-processed (lime-processed) gelatin obtained by dipping collagen in an alkali bath prior to extraction, acid-processed gelatin obtained by dipping in an acid bath, double-processed gelatin obtained by dipping in each of an alkali bath and an acid bath, and enzyme-processed gelatin. In addition, the hardener of the invention is applicable to low-molecular weight gelatin obtained by partial hydrolysis of the aforesaid gelatin by heating in a water bath or by the action of a proteolytic enzyme.

Gelatin to which the hardener of the invention is applied can be partly replaced with proteins, e.g., gelatin derivatives, colloidal albumin, casein, etc.; cellulose derivatives, e.g., carboxymethyl cellulose, hydroxyethyl cellulose, etc.; sugar derivatives, e.g., agar, sodium alginate, starch derivatives, dextran, etc.; and synthetic hydrophilic colloids, e.g., polyvinyl alcohol, poly-N-vinylpyrrolidone, polyacrylic acid copolymers, polyacrylamide or derivatives thereof or partial hydrolysates thereof.

When the hardener of the invention is used in photographic light-sensitive materials, the photographic emulsion layers or any other layers may further contain synthetic polymeric compounds, for example, latices of vinyl compound polymers, and especially compounds which enhance dimensional stability of the photographic materials, either individually or in combinations thereof, or in combination with other hydrophilic water-permeable colloids.

The hardener of the invention may be used in combination with a matting agent. The matting agent to be used preferably comprises fine particles of water-insoluble organic or inorganic compounds having a mean particle size of from 0.2 to 10 μm, and more preferably from 0.3 to 5 μm.

The gelatin hardener of the invention may further be used in combination with various color couplers, i.e., cyan, magenta, and yellow couplers. Specific examples of the cyan, magenta, and yellow couplers which can be used in this invention are described in patents cited in *Research Disclosure,* RD No. 17643, VII-D (December, 1978), and ibid., RD No. 18717 (November, 1979).

The color couplers to be incorporated in light-sensitive materials preferably have a ballast group or are polymerized so as to have anti-diffusibility. In view of smaller silver coverages required and higher sensitivity attained, 2-equivalent color couplers in which a coupling active position is substituted with a releasable group (coupling-off group) are preferred to 4-equivalent color couplers in which the coupling active position is a hydrogen atom.

The yellow couplers that can be used in combination with the hardener of the present invention include typically oil-protected type acylacetamide couplers. 2-Equivalent yellow couplers, such as those containing an oxygen atom-release type group and those containing a nitrogen atom-release type group, are preferably used. α-Pivaloylacetanilide couplers produce dyes excellent in fastness, especially to light. α-Benzoylacetanilide couplers provide dyes having high color densities.

The magenta couplers that can be used include oil-protected type indazolone or cyanoacetyl couplers, and preferably 5-pyrazolone couplers and pyrazoloazole couplers, e.g., pyrazolotriazoles. 5-Pyrazolone couplers having an arylamino or acylamino group at the 3-position are preferred in view of the hue and density of developed colors. As a releasable group for 2-equivalent 5-pyrazolone couplers, an arylthio group is particularly preferred. 5-Pyrazolone couplers having the ballast group of European Pat. No. 73,636 have an advantage of high color densities. The pyrazoloazole couplers include pyrazolobenzimidazoles, and preferably pyrazolo[5,1-c]-[1,2,4]triazoles, pyrazolotetrazoles, and pyrazolopyrazoles. From the standpoint of reduction in yellow side absorptions and light fastness of developed colors, imidazo[1,2-b]pyrazoles are preferred, with pyrazolo-[1,5-b][1,2,4]triazole being particularly preferred.

The cyan couplers that can be used include oil-protected type naphthol and phenol couplers. Typical examples of these couplers are naphthol couplers of U.S. Pat. No. 2,474,293, and preferably 2-equivalent naphthol couplers having an oxygen atom-release group.

Cyan couplers which produce dyes fast to moisture and heat are used to advantage in the present invention. Typical examples of such cyan couplers are phenol couplers having an alkyl group having at least 2 carbon atoms at the m-position of the phenol nucleus, as described in U.S. Pat. No. 3,772,002; 2,5-diacylaminosubstituted phenol couplers; phenol couplers having a phenylureido group at the 2-position and an acylamino group at the 5-position; and 2-naphthoic acid amide couplers having a hydroxyl group at the 1-position and an acylamino or alkoxycarbonylamino group at the 5-position.

In addition to the above-described color couplers, the photographic materials can contain couplers whose products have moderate diffusibility, colorless couplers, or DIR or DAR couplers capable of releasing a development inhibitor or a development accelerator, respectively, upon occurrence of the coupling reaction. The colored couplers are preferably used in color light-sensitive materials for photography with the purpose of correcting unnecessary absorptions in the shorter wavelength region possessed by colors produced from magenta and cyan couplers. Couplers whose products have moderate diffusibility are effective to improve graininess.

The DIR couplers that can be used include those releasing heterocyclic mercapto compounds; those releasing benzotriazole derivatives; colorless DIR couplers; those releasing nitrogen-containing heterocyclic compounds accompanying decomposition of a methylol group after release; those releasing development inhibitors accompanying an intramolecular nucleophilic reaction after release; those releasing development inhibitors via a conjugated system after release; those releasing diffusible development inhibitors which are inactivated in a developer; those capable of forming development inhibitors in situ or inactivating a development inhibitor through a reaction upon development; and the like.

Compounds capable of releasing antifoggants or development accelerators or precursors thereof or compounds capable of releasing electron-donating compounds or precursors thereof upon coupling reaction or oxidation reduction reaction with an oxidation product of a developing agent may also be employed.

In order to satisfy characteristic requirements for light-sensitive materials, two or more of the above-described various couplers may be incorporated into one layer, or one of them may be incorporated into two or more layers.

When the present invention is applied to silver halide light-sensitive materials, the silver halide include silver chloride, silver bromide and mixed silver halides, e.g., silver chlorobromide, silver chloroiodide, silver iodobromide, etc. The silver halide grains preferably have a mean grain size of from 0.1 to 2 μm. The grain size distribution may be either narrow or broad. So-called monodisperse silver halide emulsions, in which at least 90%, and preferably at least 95%, of the total grains in number or by weight falls within a size range of ±40% of a mean grain size can be employed in the present invention.

The silver halide grains may have a regular crystal form, such as cibic, octahedral, dodecahedral or tetradecahedral forms, an irregular crystal form, such as a spherical form, or a composite form thereof. Emulsions containing plate-like (tabular) grains having a diameter/thickness ratio of 5 or more (i.e., 5/1 or more), and particularly 8 or more, in an amount of not less than 50% based on the total projected area, may also be used.

The silver halide emulsions can be chemically sensitized by sulfur sensitization, selenium sensitization, reduction sensitization, noble metal sensitization, or the like, or combinations thereof.

The photographic emulsions can be spectrally sensitized with sensitizing dyes. Sensitizing dyes to be used include cyanine dyes, merocyanine dyes, complex cyanine dyes, complex merocyanine dyes, holopolar cyanine dyes, hemicyanine dyes, styryl dyes and hemioxonol dyes. Of these, cyanine dyes, merocyanine dyes and complex merocyanine dyes are particularly useful. To these dyes is applicable any of nuclei generally employed in cyanine dyes as a basic heterocyclic nuclei.

These sensitizing dyes may be use either individually or in combinations thereof. Combinations of sensitizing dyes are often used for the purpose of supersensitization.

For the purpose of preventing fog during preparation, preservation or photographic processing of light-sensitive materials or stabilizing photographic performance properties, the photographic emulsions can contain various compounds, such as azoles, e.g., benzothiazolium salts, benzimidazolium salts, imidazoles, benzimidazoles (preferably 5-nitrobenzimidazoles), nitroindazoles, benzotriazoles (preferably 5-methylbenzotriazoles), triazoles, etc.; mercapto compounds, e.g., mercaptothiazoles, mercaptobenzothiazoles, mercaptobenzimidazoles, mercaptobenzoxazoles, mercaptooxadiazoles, mercaptothiadiazoles, mercaptotriazoles, mercaptotetrazoles (particularly 1-phenyl-5-mercaptotetrazoles, etc.), mercaptopyrimidines, mercaptotriazines, etc.; thiocarbonyl compounds, e.g., oxazolinethione, etc.; azaindenes, e.g., triazaindenes, tetraazaindenes (particularly 4-hydroxy-6-methyl(1,3,3a,7)tetraazaindene), pentaazaindenes, etc.; benzenethiosulfonic acids, benzenesulfinic acids, benzenesulfonic acid amides; purines, e.g., adenine, etc.; and many other compounds known as antifoggants or stabilizers.

Light-sensitive materials prepared in accordance with the present invention may contain one or more surface active agents for various purposes, such as coating aid, prevention of static charge, improvement of slipperiness, emulsification and dispersion aid, prevention of adhesion, improvement on characteristic properties (e.g., accelerated development, increased contrast, increased sensitivity, etc.), and the like.

The surface active agents which can be used include nonionic surface active agents, such as saponin (steroid type), alkylene oxide derivatives (e.g., polyethylene glycol, polyethylene glycol/polypropylene glycol condensates, polyethylene glycol alkyl ethers or alkylaryl ethers, polyethylene glycol esters, polyethylene glycol sorbitan esters, polyalkylene glycol alkylamines or amides, polyethylene oxide adducts of silicon, etc.), fatty acid esters of polyhydric alcohols, alkyl esters or sugars, etc.; and anionic surface active agents containing an acid group, e.g., carboxyl group, a sulfo group, a phospho group, a sulfate group, a phosphate group, etc., such as alkylcarbonates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates, etc. Further, fluorine-containing surface active agents, such as those disclosed in Japanese Patent Publication Nos. 43130/73, 44411/81 and 9303/82, can be used to advantage.

In addition to the above-described additives, the light-sensitive materials prepared by using the present invention can contain stabilizers, stain inhibitors, developing agents or precursors thereof, lubricants, mordants, matting agents, antistatics, plasticizers, and other photographically useful compounds. Typical examples of these additives are described in *Research Disclosure,* RD No. 17643 (December, 1978) and ibid., RD No. 18716 (November, 1979).

Development processings of the light-sensitive materials prepared by using the present invention are not particularly restricted whether for color development or black-and-white development. For details, reference can be made to it in *Research Disclosure,* RD No. 17643 (December, 1978).

The present invention is now illustrated in further detail by way of the following examples, but it should be understood that the present invention is not limited thereto. In these examples, all the percents are by weight unless otherwise indicated.

EXAMPLE 1

Each of Compounds 16, 17 and 19 according to the present invention, Comparative Compound (I) of formula shown below (disclosed in Japanese Patent Publication No. 32699/83 as Compound No. 15) and Comparative Compound (II) of formula shown below (disclosed in Example II of U.S. Pat. No. 3,642,486) was added to a 7% aqueous gelatin solution in an amount indicated in Table 1, and the resulting gelatin solution was coated on a triacetyl cellulose support to a dry thickness of about 8 μm and dried to prepare Gelatin Layers (A) to (I). For control, Gelatin Layer (J) was prepared in the same manner as above, except using no hardener.

Comparative Compound (I)

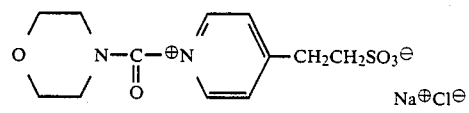

Comparative Compound II)

$CH_2{=}CHSO_2CH_2OCH_2SO_2CH{=}CH_2$

Each of Layers (A) to (J) was allowed to stand at 25° C. and 50% RH (relative humidity) for a prescribed period of time, and a crosslinking coefficient δ (number of crosslinked units per weight average molecular weight of non-crosslinked gelatin) was determined with time in accordance with the following method. The results obtained are shown in Table 1.

Determination of Crosslinking Coefficient

Each gelatin layer was separated from the support, and its weight ($M_1$) was measured. A sol fraction was extracted from the gelatin layer with warm water, and the weight of the gelatin ($M_2$) was determined with a microburette. A sol fraction ratio S was obtained from the following equation.

$$S = M_2/M_1$$

The value δ was calculated from S according to the following equation described in A. Charlesby, *Atomic Radiation and Polymers,* pp. 134–158, Pergamon Press (1960).

$$\delta = \frac{2}{S + \sqrt{S}}$$

TABLE 1

| Gelatin Layer | Gelatin Hardener | Amount Added (mmol/100 g-gelatin) | δ After 2 Hrs | δ After 1 Day | δ After 3 Days | δ After 7 Days |
|---|---|---|---|---|---|---|
| (A) | Compound 16 | 12 | 3.2 | 3.3 | 3.3 | 3.3 |
| (B) | Compound 16 | 25 | 5.8 | 5.7 | 5.8 | 5.7 |
| (C) | Compound 17 | 12 | 3.1 | 3.1 | 3.0 | 3.0 |
| (D) | Compound 17 | 25 | 5.2 | 5.3 | 5.3 | 5.2 |
| (E) | Compound 19 | 12 | 3.5 | 3.5 | 3.5 | 3.4 |
| (F) | Compound 19 | 25 | 5.9 | 6.0 | 5.9 | 5.9 |
| (G) | Comparative | 12 | 3.2 | 3.1 | 3.0 | 3.2 |

TABLE 1-continued

| Gelatin Layer | Gelatin Hardener | Amount Added (mmol/100 g-gelatin) | δ After 2 Hrs | δ After 1 Day | δ After 3 Days | δ After 7 Days |
|---|---|---|---|---|---|---|
| (H) | Compound (I) Comparative Compound (I) | 25 | 5.0 | 5.1 | 4.9 | 5.1 |
| (I) | Comparative Compound (II) | 4 | 1.2 | 2.8 | 4.6 | 5.4 |
| (J) | None | 0 | 1.0 | 1.0 | 1.0 | 1.0 |

As can be seen from the results of Table 1, any of Layers (A) to (H) wherein Compounds 16, 17, and 19 and Comparative Compound (I) were used shows rapid hardening progress, and the hardening reaction completes within about 2 hours after the coating. Thereafter, the value δ does not change any more. To the contrary, Comparative Compound (II) is so low in hardening progress, showing a significant increase even after the lapse of 3 days from the coating (after-hardening). It is clear, therefore, that the hardeners according to the present invention and Comparative Compound (I) exhibit high rates of hardening and substantially no after-hardening.

EXAMPLE 2

A photographic emulsion for color prints was prepared in a conventional manner using 75 g/kg of gelatin, 18 g/kg of silver chlorobromide, and a coupler dispersion comprising 18 g/kg of a magenta coupler of formula shown below, 10 g/kg of tricresyl phosphate, and 6 g/kg of tris(2-ethylhexyl) phosphate. To the emulsion (1 kg) was added 5.1 g of Compound 17 containing 15% NaCl, and the resulting coating composition was uniformly coated on a support for color prints having a subbing layer to a dry coverage of 5 g/m$^2$ to obtain Sample A1 comprising a single magenta layer. Magenta Coupler:

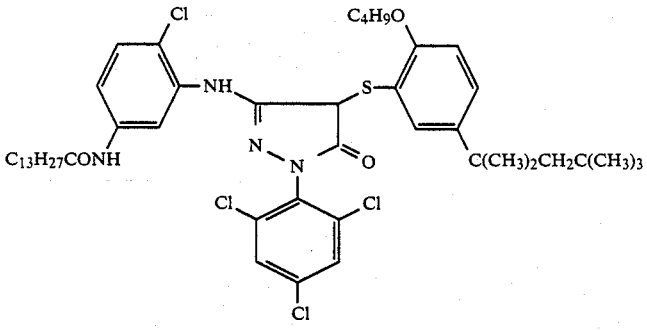

Sample A2 was prepared in the same manner as for Sample A1, except that the coupler dispersion comprising the magenta coupler and phosphates as used in Sample A1 was not used.

Samples B1 and B2 were prepared in the same manner as for Samples A1 and A2, respectively, except for using 5.8 g of Compound 19 containing 16% NaCl in place of 5.1 g of Compound 17. Samples C1 and C2 were prepared in the same manner as for Samples A1 and A2, respectively, except for using 5.4 g of Comparative Compound (I) containing 17% NaCl as used in Example 1 in place of 5.1 g of Compound 17.

Each of the resulting samples was allowed to stand at room temperature for 2 days and was then immersed in a 0.2 N aqueous solution of sodium hydroxide at 60° C. The time that had elapsed until the gelatin layer began to be dissolved was determined. The results obtained are shown in Table 2.

TABLE 2

| Sample No. | Gelatin Hardener | Emulsion | Time Required for Gelatin Layer to Begin to Be Dissolved (sec) |
|---|---|---|---|
| A1 | Compound 17 | Used | 1,025 |
| A2 | Compound 17 | Not used | 1,010 |
| B1 | Compound 19 | Used | 1,185 |
| B2 | Compound 19 | Not used | 1,205 |
| C1 | Comparative Compound (I) | Used | 785 |
| C2 | Comparative Compound (I) | Not used | 1,055 |

Comparing Samples A1 and B1 containing the coupler dispersion with Samples A2 and B2 containing no coupler dispersion, no substantial difference was observed in the time required for the gelatin layer to begin to be dissolved depending on whether the coupler dispersion is present or not. In other words, the time required for the layer to be dissolved is not reduced by hardening inhibition due to the presence of the coupler-/oil dispersion. On the other hand, Sample C1 containing the coupler dispersion undergoes serious hardening inhibition as compared with Sample C2 containing no, coupler dispersion. From these results, it is apparent that the compounds according to the present invention are hardeners free from hardening inhibition due to the presence of a coupler/oil dispersion.

EXAMPLE 3

A silver iodobromide emulsion containing 3.0 mol % of silver iodide was prepared and subjected to after-ripening in the presence of sodium thiosulfate and sodium tetrachloroaurate so as to attain the highest possible sensitivity to obtain a highly sensitive negative emulsion.

1-(2',4',6'-Trichlorophenyl)-3-[3''-(2''',4'''-di-t-amylphenoxyacetamido)benzamido]-5-pyrazolone was dissolved in a mixed solvent of dibutyl phthalate and tricresyl phosphate, and the solution was dispersed in an aqueous gelatin solution using sorbitan monolaurate, Turkey red oil, and sodium dodecylbenzenesulfonate as emulsifiers to prepare an oil-in-water coupler dispersion. The resulting coupler dispersion was mixed with the above-prepared high-sensitivity negative emulsion, and to the mixture was added Compound 19 (containing 16% NaCl) in an amount of 9.7 g per 100 g of dry gelatin. The resulting coating composition was coated on a triacetyl cellulose support having a subbing layer to provide a layer having a dry thickness of about 10 μm, and thus obtain a color film comprising a single magenta layer.

The film was wedgewise exposed to light and subjected to color development processing using 4-amino-3-methyl-N-ethyl-β-hydroxyethylaniline sesquisulfate as a developing agent.

As a result of sensitometrical evaluation on color formation characteristics, it was found that the compound of the invention neither impairs color formation properties of the coupler nor causes color stain.

While the invention has been described in detail and with reference to specific embodiments thereof, it will be apparent to one skilled in the art that various changes and modifications can be made therein without departing from the spirit and scope thereof.

What is claimed is:

1. A photographic light-sensitive material comprising a support and at least one gelatin-containing layer provided on the support, wherein said gelatin-containing layer contains as a gelatin hardener at least one compound represented by the formula (I)

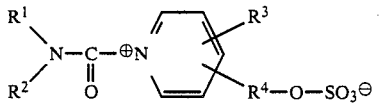

(I)

wherein $R^1$ and $R^2$ each represents a substituted or unsubstituted alkyl group, a substituted or unsubstituted aryl group, or a substituted or unsubstituted aralkyl group, or $R^1$ and $R^2$ together represent a nitrogen-containing heterocyclic ring; $R^3$ represents a hydrogen atom, a halogen atom, an alkyl group, an aryl group, an aralkyl group, or an alkoxy group; and $R^4$ represents a chemical bond, or an alkylene group, an arylene group, or a divalent group composed of these groups.

2. A photographic light-sensitive material as in claim 1, wherein $R^1$ and $R^2$ each represents a straight or branched chain alkyl group having from 1 to 20 carbon atoms, an aralkyl group having from 7 to 20 carbon atoms, or an aryl group having from 6 to 20 carbon atoms, or $R^1$ and $R^2$ together represent a pyrrolidine ring, a piperidine ring, or a morpholine ring.

3. A photographic light-sensitive material as in claim 1, wherein $R^1$ and $R^2$ each represents an alkyl group having from 1 to 3 carbon atoms or a phenyl group.

4. A photographic light-sensitive material as in claim 1, wherein $R^3$ represents a hydrogen atom, a halogen atom, an alkyl group having from 1 to 20 carbon atoms, an aryl group having from 6 to 20 carbon atoms, an aralkyl group having from 7 to 20 carbon atoms, or an alkoxy group having from 1 to 20 carbon atoms.

5. A photographic light-sensitive material as in claim 1, wherein $R^3$ represents a hydrogen atom.

6. A photographic light-sensitive material as in claim 1, wherein $R^4$ represents a chemical bond, or an alkylene group having from 1 to 20 carbon atoms, an arylene group having from 6 to 20 carbon atoms, or a divalent group composed of these groups having from 7 to 20 carbon atoms.

7. A photographic light-sensitive material as in claim 1, wherein $R^4$ represents a chemical bond, a methylene group, an ethylene group, or a trimethylene group.

8. A photographic light-sensitive material as in claim 1, wherein the compound is present in an amount of from 0.01 to 20% by weight based on the weight of dry gelatin.

9. A photographic light-sensitive material as in claim 1, wherein the compound represented by formula (I) is present in an amount of from 0.05 to 10% by weight based on the weight of dry gelatin.

10. A photographic light-sensitive material as in claim 1, wherein said photographic light-sensitive material is a color photographic light-sensitive material.

* * * * *